United States Patent [19]

Libin

[11] Patent Number: 4,632,095

[45] Date of Patent: Dec. 30, 1986

[54] PRESSURE-POINT ATTACHMENT FOR USE WITH ELECTRICAL HAND-HELD MASSAGERS

[75] Inventor: Robert P. Libin, Encino, Calif.

[73] Assignee: Tamiko Inc., Encino, Calif.

[21] Appl. No.: 668,135

[22] Filed: Nov. 5, 1984

[51] Int. Cl.[4] ..... A61H 7/00

[52] U.S. Cl. ..... 128/67; 128/60

[58] Field of Search ..... 128/24.1, 67, 60, 61, 128/44

[56] References Cited

U.S. PATENT DOCUMENTS

| | | | |
|---|---|---|---|
| 782,715 | 2/1905 | Barker | 128/67 |
| 1,291,290 | 1/1919 | Veomett | 128/67 |
| 1,594,636 | 8/1926 | Smith | 128/32 X |
| 2,074,735 | 3/1937 | Puttcamp | 128/67 |
| 2,450,935 | 10/1948 | Carr | 128/61 X |
| 3,363,623 | 1/1968 | Atwell | 128/44 |
| 3,364,291 | 1/1968 | Deichert et al. | 264/255 |
| 4,233,966 | 11/1980 | Takahashi | 128/67 |
| 4,520,798 | 6/1985 | Lewis | 128/60 |

FOREIGN PATENT DOCUMENTS

| | | | |
|---|---|---|---|
| 1022751 | 3/1953 | France | 128/24.1 |
| 2133990 | 8/1984 | United Kingdom | 128/32 |

*Primary Examiner*—Edgar S. Burr
*Assistant Examiner*—Tonya Eckstine
*Attorney, Agent, or Firm*—Albert O. Cota

[57] ABSTRACT

A pressure-point attachment designed to slip over the vibrating head of a hand-held electrical vibrator. The attachment is used to apply point-pressure combined with vibration to body pressure points that correspond to body organs, nerves and glands as disclosed in the field of reflexology massaging. The attachment is comprised of a circular disk having a conical finger extending upwardly from the center of the disk. The finger is covered with a resilient cup that is designed to allow the user to provide the proper firmness to the body pressure-points. Around the periphery of the disk is a ledge that has a plurality of gripping tabs that allow the disk to be securely held to the vibrating head of the vibrator.

2 Claims, 5 Drawing Figures

Fig.1.
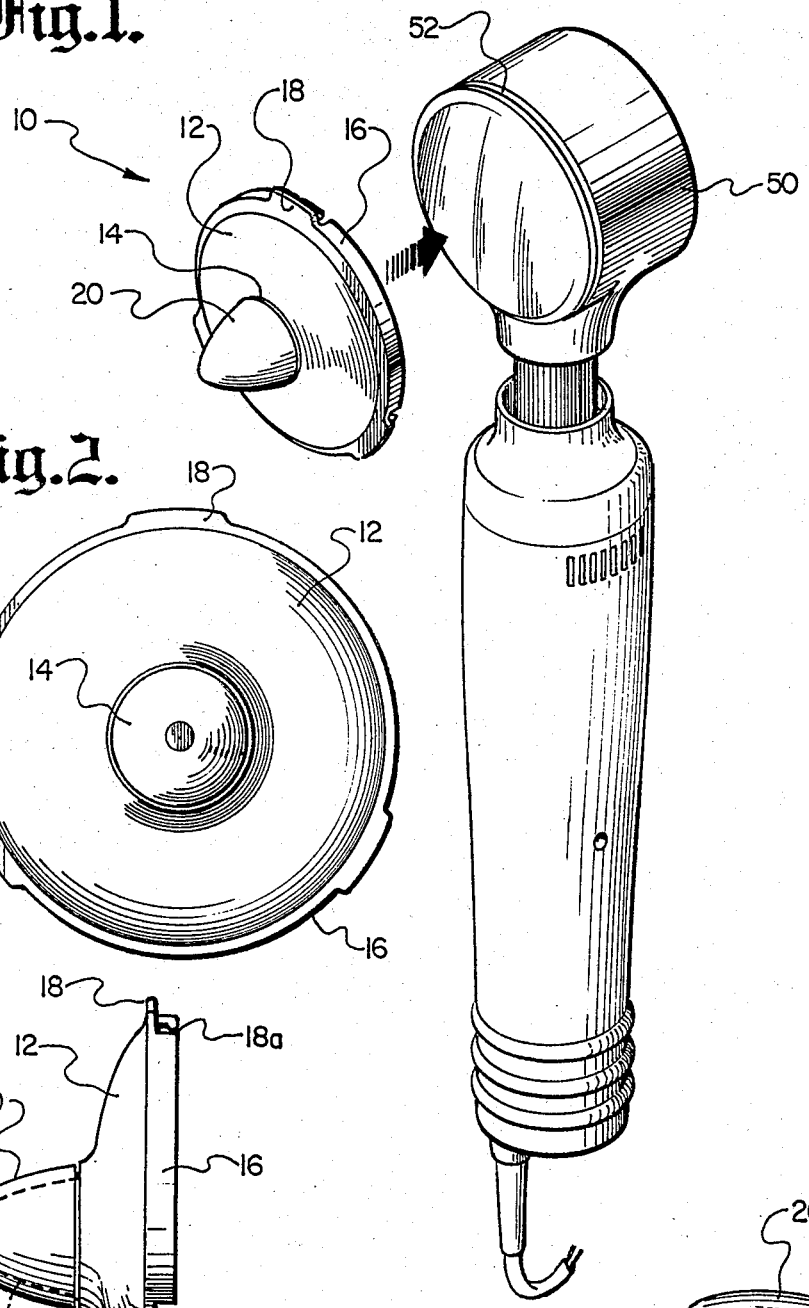
Fig.2.
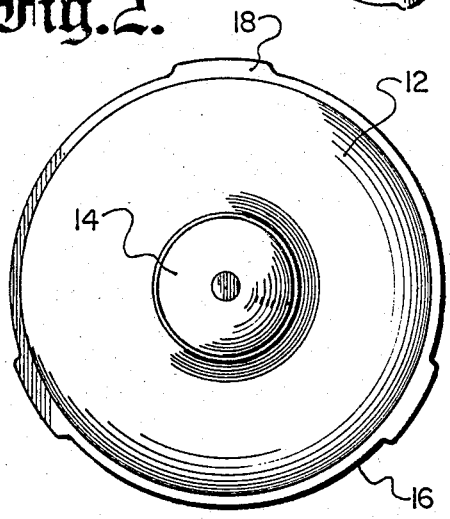
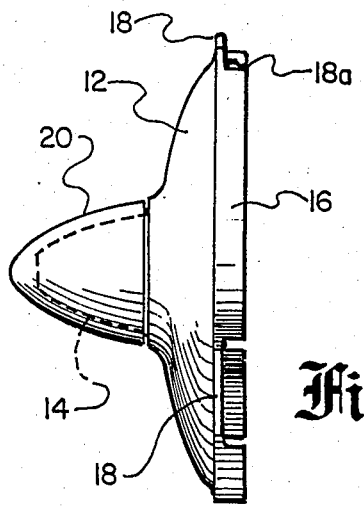
Fig.3.
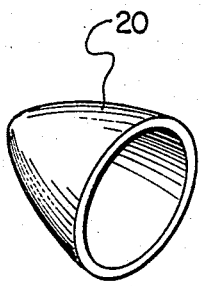
Fig.4.

REFLEXOLOGY MASSAGING PRESSURE POINTS

PRESSURE-POINT ATTACHMENT FOR USE WITH ELECTRICAL HAND-HELD MASSAGERS

TECHNICAL FIELD

The invention pertains to the general field of attachment devices for electrical massagers and more particularly to a pressure-point attachment that can be used for acupressure therapy.

BACKGROUND ART

In the field of reflexology massaging there is taught that there are various organs, nerves, and glands in the body that are connected with certain "reflex areas" on the bottoms of your feet, hands, and other areas of the body. This same teaching involves massaging these corresponding reflex areas, and through resulting stimulatory responses, prompt help for various conditions in the body can often be obtained. In most instances the thumb, or perhaps the knuckle, is the massaging force; others may use vibrators or other external mechanical forces.

Considerable substantiation has been given reflexology massaging which is based on the same principles of bio-mechanism by which the long established field of acupuncture works. Many practitions are now using "acupressure" in lieu of "acupuncture" for a variety of conditions, including headaches and toothaches. Thus, use should not be misinterpreted to mean that the methodology of reflexology massaging will automatically remedy the cause of pain in these two instances. However, in many cases of gland or organ congestion, there have been successful results reported.

One of the problems associated with applying the principal of reflexology massaging is that aside from finger or knuckle pressure there are no electrically stimulated devices specifically designed to apply proper point-pressure to selected body areas.

A search of the prior art did not disclose any patents that dealt with reflexology massaging or that directly read on the claims of the instant invention. However, the following U.S. patents were considered related and indicative of the art in electrical vibrators:

| U.S. PAT. NO. | INVENTOR | ISSUED |
|---|---|---|
| 3,364,921 | Reiter | 23 January 1968 |
| 2,074,735 | Puttcamp | 23 March 1937 |
| 1,594,636 | Smith | 3 August 1926 |
| 782,715 | Barker | 14 February 1905 |

The Reiter patent discloses a reflex vibration attachment for use with a conventional type of hand operated vibrator. The attachment produces a modified or reflex vibrating action in lieu of the stronger vibrating action normally resulting from the direct application of the vibrating head portion of the vibrator to the body.

The Puttcamp patent discloses a hand operated device for massaging and applying a facial or shaving cream to a persons face. The device head is provided with spiral ridges to allow the shaving cream to be emitted and distributed. The massaging head is also designed to conform to the contour of the users face and is covered with a detachable resilient covering that may be replaced when worn.

The Smith patent discloses a liquid reservoir applicator for use on hand held electrical vibrators. The applicator is designed to hold a quantity of liquid and to permit the liquid to be distributed to the part of the body being massaged during the massaging treatment.

The Barker patent discloses a massaging device that is secured to a vibrating shaft of a vibrator. The device consists of a disk made of a resilient material and that has a plurality of finger-like studs that project upwardly from the surface of the disk.

DISCLOSURE OF THE INVENTION

The usefulness of reflexology massaging is based on the teaching that there are a plurality of pressure-points located throughout the body, hands and feet that correspond to various body organs, nerves and glands. The inventive pressure-point attachment is used in combination with a hand-held electrical vibrator to apply pressure together with a vibration to these body pressure points to effect a stimulatory response.

The pressure-point attachment is comprised of a slightly convex disk that has an upright conical finger projecting from its center. A resilient cup having the approximate shape as the finger is slipped over and rigidly attached to the finger. The resilient cup is sized to the proper size and firmness to allow a user to provide the proper pressure to the body pressure-point being massaged. The attachment is also designed with a peripheral ledge around the disk where the ledge includes a plurality of gripping tabs that allow the attachment to be securely held against the edge of the vibrating head of the electrical vibrator. The combination peripheral ledge and gripping tabs also allow the attachment to be easily and quickly attached and detached to the vibrating head.

The primary object of the invention is to provide a pressure-point attachment that facilitates and enhances the application of reflexology massaging by providing an attachment that allows the proper pressure and vibration to be applied to the selected body pressure points.

In addition, it is also an object of the invention to provide a pressure-point attachment that is:

cost-effective to manufacture,
replaceable,
maintenance free and
easy to use.

These and other objects and advantages of the present invention will become apparent from the subsequent detailed description of the preferred embodiment and the claims taken in conjunction with the accompanying drawings.

BRIEF DESCRIPTION OF THE DRAWINGS

The details of the invention are described in connection with the accompanying drawings in which:

FIG. 1 is a perspective view of the pressure-point attachment and a typical vibrator having a vibration head to which the attachment is attached.

FIG. 2 is a top view of the pressure-point attachment.

FIG. 3 is a side view of the pressure-point attachment.

FIG. 4 is a perspective view of the resilient conical finger.

BEST MODE FOR CARRYING OUT THE INVENTION

Figure 5:
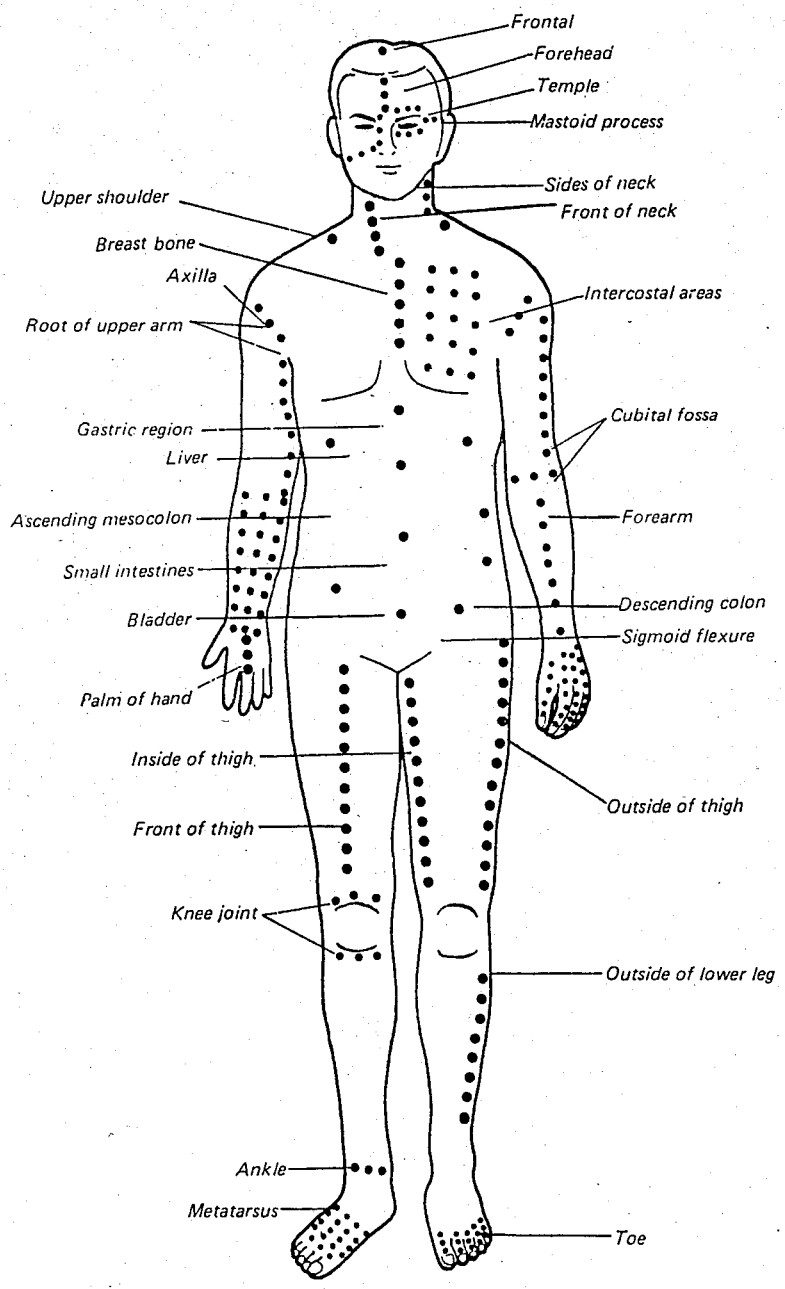
FIG. 5 is a front view of a human body showing some of the body pressure-points.

The best mode for carrying out the invention is shown in FIGS. 1–4. The pressure-point attachment in the preferred embodiment is designed to fit over the vibrating head 50 of an electrical vibrator of the general type as shown in FIG. 1. The pressure-point attachment 10 is comprised of two major elements: a circular disk 12 having an upright conical finger 14 and a resilient pressure-point cup 20.

The disk is slightly convex in the forward direction and has the conical finger 14, as best shown in FIGS. 3 and 4, extending upwardly from its center front surface. The disk in the preferred embodiment is designed and sized to fit over the circular head of an electrical vibrator such as the UNICORN MK III distributed by Tamiko Incorporation of Encino, Calif.

To allow the disk 12 to be easily and quickly attached to the vibrating head 50, it is designed with a ledge 16 that extends downwardly at 90-degrees around its periphery as best shown in FIG. 3. The ledge further has a plurality of equally spaced flexible griping tabs 18 that have a ridge 18*a* located on the inside surface of the tabs that allow the tabs to provide gripping pressure to the head 50. The tabs because of their size and material give slightly and allow them to securely grip the side edge 52 of the vibrating head 50.

In the preferred embodiment the finger 14, the ledge 16 and the gripping tabs 18 are an integral part of the disk 12 which is injected molded of a plastic material such as ABS, acrylic or a polycarbonate.

To provide further comfort to the user, during point-contact to the body, the resilient pressure-point cup 20, as best shown in FIG. 4 is employed. The cup in the preferred embodiment is designed to the proper size and firmness and is made of rubber, however, other resilient material may also be used. The cup 20 is sized to fit over the upright conical finger 14 and is held in place by applying a compatible adhesive, such as a contact cement, to the respective joining surfaces.

The pressure-point attachment 10 is used in combination with the electrical vibrator 50 to apply point-pressure to selected body pressure points as specified in reflexology massaging.

In reflexology massaging there is disclosed a multiplicity of pressure points located throughout the body, hands and feet that correspond to various body organs, nerves and glands. By properly massaging these pressure-points and through resulting simulatory responses it has been found that in many cases various body aches and pains can be relieved.

To use the pressure-point attachment 10 a pressure-point corresponding to a particular body ailment is located by referring to a reflexology chart that is found in a variety of reflexology and acupressure publications. A typical chart showing some of the pressure points in the body is included as FIG. 5. After the applicable pressure-point is located, the conical finger 14 is placed against the body pressure-point and the vibrator 50 is turned on. Before a treatment is commenced, a person knowledgeable in reflexology massaging principles and techniques should be consulted.

Although the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. A pressure point attachment designed to fit onto the vibrating head of an electrical massager where said attachment comprises:

(a) a circular disk having a front surface and a back surface, (b) said front surface having a conical projection beginning on it's surface and extending outwardly, (c) a resilient pressure point cover adhesively secured on said conical projection, (d) means for selectively releasably attaching said disk to the vibrating head of said electrical vibrator for massaging selected body pressure points (e) the means for attaching said disk to the vibrating head of said electrical vibrator consisting of a ledge extending downwardly at 90 degrees from substantially the entire periphery of said back surface of said disk and said ledge having a plurality of flexible gripping tabs thereupon for gripping the vibrating head, (f) said vibrating head having a circumferential edge including means to retain said tabs on said edge, and (g) said tabs further comprising a longitudinal ridge located on the inside surface of said tabs providing gripping pressure to said means to retain.

2. The pressure point attachment as specified in claim 1 wherein said conical projection, said ledge and said gripping tabs are integrally molded into said circular disk.

* * * * *